US008074667B2

(12) United States Patent
Villanueva

(10) Patent No.: US 8,074,667 B2
(45) Date of Patent: Dec. 13, 2011

(54) UNDER-EYE MAKEUP SHIELD

(76) Inventor: Michelle Villanueva, Placentia, CA (US)

( * ) Notice: Subject to any disclaimer, the term of this patent is extended or adjusted under 35 U.S.C. 154(b) by 52 days.

(21) Appl. No.: 12/697,158

(22) Filed: Jan. 29, 2010

(65) Prior Publication Data

US 2011/0088716 A1 Apr. 21, 2011

Related U.S. Application Data

(63) Continuation-in-part of application No. 11/986,077, filed on Nov. 19, 2007, now abandoned.

(51) Int. Cl.
*A45D 40/30* (2006.01)

(52) U.S. Cl. ..... 132/319; 2/9

(58) Field of Classification Search ..... 132/319, 132/320, 333; 2/9, 206; 128/857; 602/41, 602/52, 54, 57, 74
See application file for complete search history.

(56) References Cited

U.S. PATENT DOCUMENTS 2,033,691 A * 3/1936 Douglass ..... 2/174
4,807,650 A * 2/1989 Bliss ..... 132/319

* cited by examiner

*Primary Examiner* — Todd Manahan
*Assistant Examiner* — Brianne O'Neill
(74) *Attorney, Agent, or Firm* — Craig A. Fieschko, Esq.; DeWitt Ross & Stevens S.C.

(57) ABSTRACT

A makeup shield patch of material is curved at the top to fit under the eye. The front of the patch has a textured surface to catch falling eye makeup. The back of the patch has a weak adhesive which is gentle to the skin. Peel-off strips over the back adhesive surface are scored so that a narrow top peel-off strip or two end peel off strips are peeled off and the upper attaching portion adhered to the skin under the eye. The bottom part of the peel-off strip is left in place so the shield does not stick to or disturb any makeup on the cheek. A plurality of makeup shields are die-cut from a sheet of tape with a weak skin sensitive adhesive covered by scored peel off strips.

20 Claims, 3 Drawing Sheets

FIG. 1
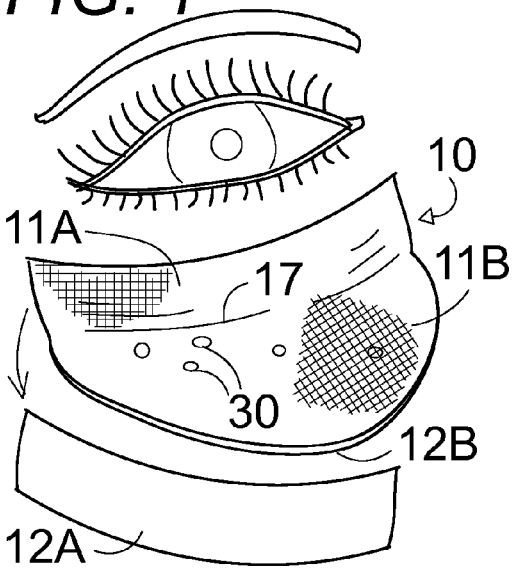
FIG. 2
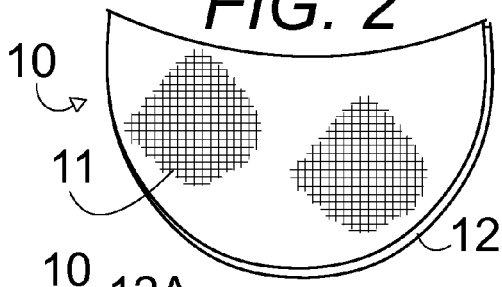
FIG. 3
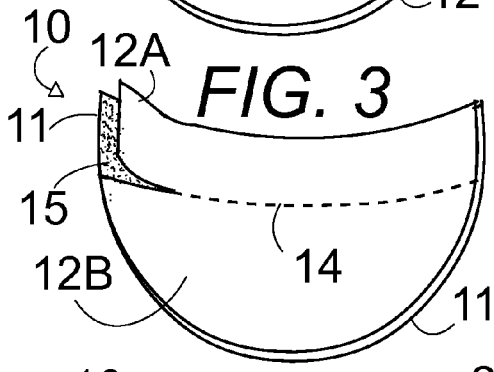
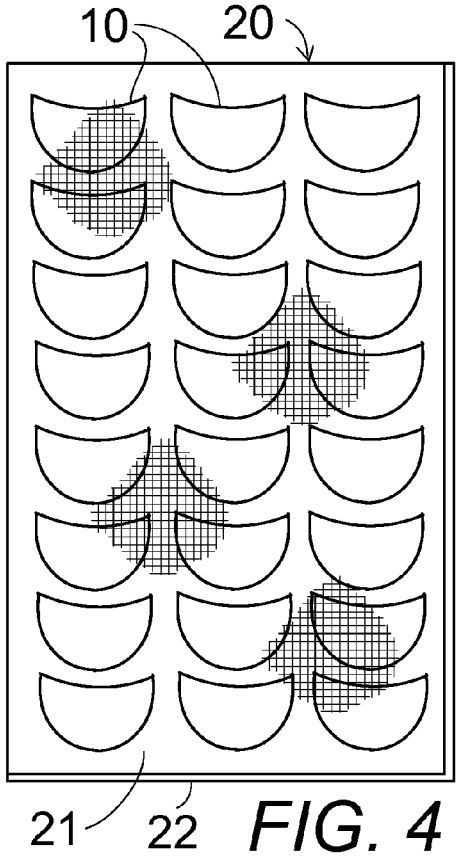
FIG. 4
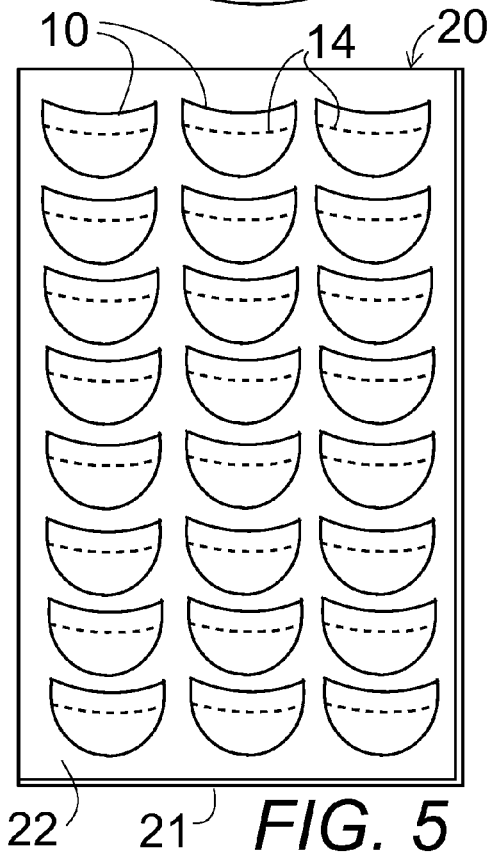
FIG. 5

FIG. 7
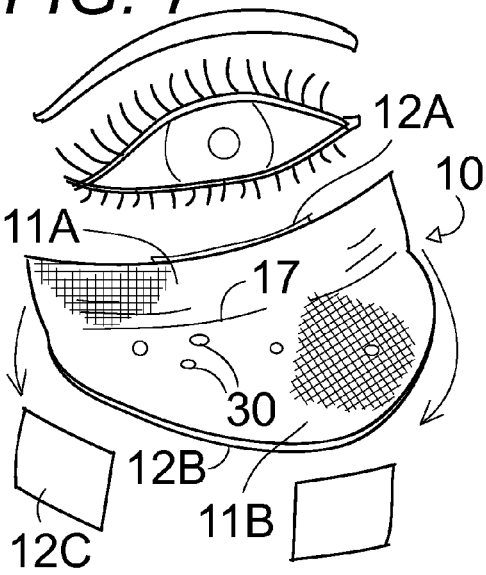
FIG. 8
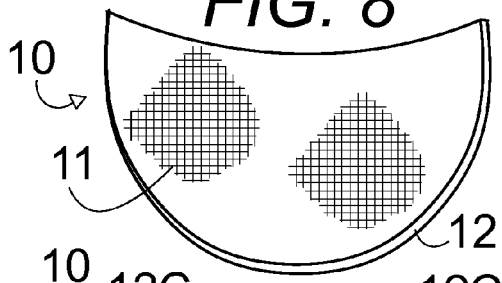
FIG. 9
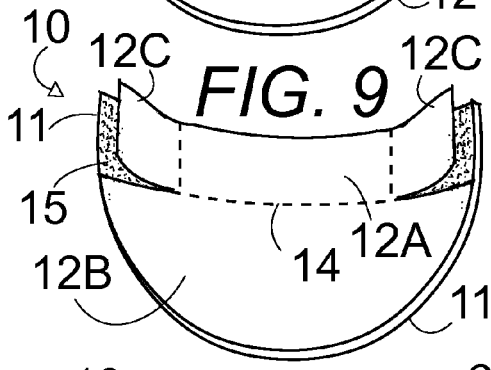
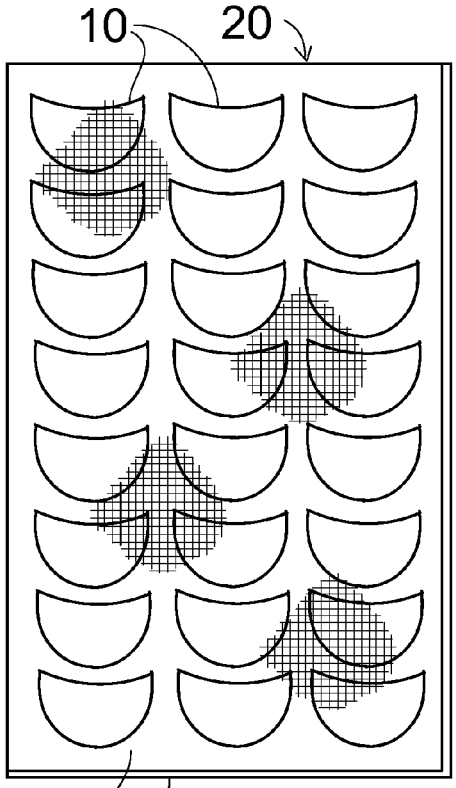
FIG. 10
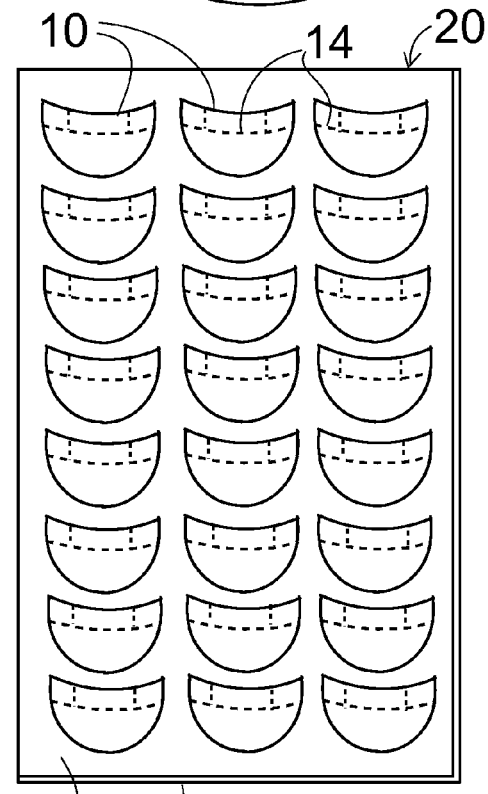
FIG. 11

UNDER-EYE MAKEUP SHIELD

CROSS-REFERENCE TO RELATED APPLICATIONS

The present utility patent application is a continuation-in-part of utility patent application Ser. No. 11/986,077 filed Nov. 19, 2007.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to protective shields and particularly to a makeup shield that is removably affixed under the eye for putting on eye makeup to prevent eye shadow, eyeliner, and mascara from falling on the skin below the eyes and on the cheeks; the makeup shield comprises a die-cut patch of material which is curved at the top to fit under the eye matching the curvature of the bottom eyelid, a front of the patch having textured surface to catch the falling eye makeup, a back of the patch having a weak adhesive thereon which is kind to the skin, and a peel-off strip over the entire back adhesive surface which is scored so that a narrow top peel-off strip or two narrow end top peel-off strips may be peeled off and the shield adhered to the skin under the eye, the bottom part of the peel-off strip being left in place so that the shield does not stick to the cheek and does not disturb any makeup on the cheek.

2. Description of Related Art Including Information Disclosed Under 37 CFR 1.97 and 1.98

In applying eye makeup including eye shadow, mascara, and eye liner, there is a problem with some of the eye makeup falling down onto the skin under the eye or onto the cheek to produce smudging of the eye makeup on the skin in trying to remove the fallen particles of eye makeup. Considerable time can be wasted in trying to remove the smudges. If foundation and other makeup has already been applied to the cheeks, the fallen eye makeup can make a mess of that and require redoing the foundation or makeup on the cheeks, and so wasting more time.

There are many prior art eye makeup shields with an elongated handle that a person holds in one hand while putting on eye makeup. Examples of which may be found in U.S. Patent Application Nos. 20060225761; 20050022838; 20040231688; 20030094184; 20020124865 and U.S. Pat. Nos. 1,873,928; 1,907,476; 1,974,825; 3,789,856; 3,884,232; 4,033,364; 5,016,658; 5,052,417; 5,178,170; 5,311,888; 5,890,499; 5,957,142; 6,199,560; 6,807,970; D119,329; D252,890; D255,606; D254,935; D257,400; D271,530; D316,312; D337,854; D341,001; D423,714; D532,929; and D536,129. A makeup artist or a person putting on makeup holds the device with one hand while applying the eye makeup with the other hand. Often there is a color palette, cosmetics container, bottle or other container which also needs to be held, so holding a shield is a nuisance. Prior art patents have not really found an adequate solution which can be made and sold in quantity easily and inexpensively for a disposable eye makeup shield which does not require holding the shield.

U.S. Pat. No. 4,807,650, issued Feb. 28, 1989 to Bliss, is for a coverture for protecting a portion of the face from make-up during application of the make-up to the face. The coverture comprises a shield having at least one make-up impervious section and a means for holding the shield adjacent the protected portion of the face during the application of the make-up. Additionally, a method of applying make-up to a first portion of the face comprises the steps of holding a shield adjacent a second portion of the skin to which make-up is not to be applied, applying make-up to the fast portion of the face, and removing the shield from the first portion of the face, wherein the shield has at least one make-up impervious portion.

U.S. Pat. No. 2,033,691, issued Mar. 10, 1936 to Douglass, provides a face shield which comprises a visor having an adhesive strip and which is removably attached to a person's forehead using said adhesive strip.

U.S. Pat. No. 6,640,814, issued Nov. 4, 2003 to Burke, shows a mascara application shield and handheld shield holder. The shield holder has a manually-engageable handle on its lower end and a spoon-shaped panel on its upper end. It is curved from top to bottom. The shield holder releaseably holds a mascara shield made of soft, flexible sheet material provided with repositionable pressure-sensitive adhesive. The mascara shield is held under the eyelashes when mascara is being applied to avoid deposit of the mascara on the skin below the eyes. The handle is long enough and curved enough to hold the shield in place when it is positioned by hand, without interfering with the mascara-applying hand.

U.S. Pat. No. 5,765,231, issued Jun. 16, 1998 to Leonard, claims a segmental face mask suitable for application to a skin surface of a person's face, the face mask comprising a plurality of facial mask segments of resilient polymeric foam, each segment conformable to at least a portion of the surface of the person's face and including a first surface, a second surface and a shaped peripheral margin, an adhesive attachment, suitable for use on the first surface of each segment and suitable for attaching the segment to the person's skin; and a decoration, suitable for application on the second surface of each segment, for decorating the face mask; wherein the plurality of facial mask segments cover substantially all of the surface of the skin of the person's face.

U.S. Pat. No. 5,592,687, issued Jan. 14, 1997 to Lajeunesse, describes a facial insulator for restricting heat loss from exposed skin surfaces. In a general embodiment, the facial insulator comprises a support pad having a design surface for displaying a design and an opposed adhesive surface having an edge strip along a perimeter edge of the pad and an insulating area defined by the edge strip as a circumference of the insulating area. A pressure-sensitive adhesive covers the edge strip, and an insulating material is affixed to the insulating area of the adhesive surface of the insulating pad. At least one downstream vent break and at least one upstream vent break are in generally opposed locations on the edge strip for permitting air to flow through the insulating material to remove any perspiration or moisture. A release layer is affixed to and covers the adhesive surface of the support pad. In a further embodiment, the facial insulator of the invention may comprise a facial insulator set including insulators dimensioned in the shape of thin-flesh facial areas such as a nose bridge facial insulator and a pair of upper cheek bone facial insulators, so that only those thin-flesh areas are covered; and the vent breaks of the nose bridge and upper cheek bone facial insulators are positioned along their edge strips to facilitate movement of ordinary air currents through the insulating material, such as air currents passing over exposed facial skin surfaces of a down hill skier.

U.S. Pat. #D467,034, issued Dec. 10, 2002 to Jaggers, discloses the ornamental design for a lower eyelash cosmetology shield.

U.S. Pat. No. 2,260,614, issued Oct. 28, 194 to Freitas, indicates an eye shield of a generally hour glass shape and having a pair of opposed concave end edges. The concave edges are used to shield the eyelids during the application of mascara.

U.S. Pat. No. 5,050,624, issued Sep. 24, 1991 to Kobe, puts forth a disposable eye makeup shield for use during the application of eye makeup being specifically structured to provide a barrier or protective shield over the lower eyelid and areas of the user's face below the eyes, thereby preventing excess makeup from falling thereon or onto the user's clothing during makeup application. The makeup shield includes a flexible, yet rigid interior body forming a frame structure and having an outer convex, arcuate side and an inner concave side, the interior body defining an overall general configuration of the eye makeup shield. The interior body further includes a lower portion and an upper portion having outwardly extending wings and a top edge being specifically curved and configured to conform with the contour of the user's lower eyelid. An outer layer of substantially porous, absorbent material is adhered to the convex outer side of the interior body and an inner, congruent layer of substantially soft material is adhered to the concave inner side of the interior body, the outer porous material being adapted to catch and substantially absorb makeup falling thereon during application. The lower portion of the interior body includes a grasping area to facilitate holding and positioning of the makeup shield in a preferred position against the lower eyelid.

U.S. Pat. No. 6,305,389, issued Oct. 23, 2001 to Bakken, concerns a mascara application guard made of a hypoallergenic material such as silicone. It has an irregular shape, and is about 109 mm long and about 52 mm wide. The guard has different sized curvatures to fit the different size of eyes found in human beings. At one end of the guard, a curvature of approximately 25 mm is used for persons having small sized eye sockets. At the opposite end of the guard a medium size curvature of approximately 32 mm is available for persons having medium sized eye sockets. A very large curvature is located perpendicular to the medium sized curvature. This larger curvature is approximately 34 mm in radius. Each of the three curvatures has a raised edge in order to facilitate its use. The guard is used by placing it underneath the lower eyelashes or on top of the upper eyelashes. Mascara may then be applied to the eyelashes. The guard prevents the mascara from also being deposited on the skin underneath the guard.

U.S. Pat. No. 1,850,540, issued Mar. 22, 1932 to Erickson, illustrates a protective shield for protecting the eyes, eyelids, skin and parts of the face adjacent to the eyes during the application of makeup to the eyelashes and eyebrows.

What is needed is a simple inexpensive eye makeup shield which adheres to the face of a user underneath the eye, which shield may be economically die cut in quantity from a sheet of medical tape backed with skin sensitive adhesive and having a multi-part peel off strip over the adhesive, so that each shield peel off backing is scored between a multi-scored top peel off strip and a bottom portion left on the shield to cover the cheek without adhering to it.

BRIEF SUMMARY OF THE INVENTION

An object of the present invention is to provide a simple inexpensive eye makeup shield which adheres to the face of a user underneath the eye, which shield may be economically die cut in quantity from a sheet of medical tape backed with skin sensitive adhesive and having a peel off strip over the adhesive, so that each shield peel off backing is scored between a top multi-scored peel off strip and a bottom portion left on the shield to cover the cheek without adhering to it, and a quantity of the shields packaged together for use one at a time in shielding the under-eye area and the cheek to prevent mascara, eye liner, and eye shadow from falling on the skin and smearing or damaging a foundation or other makeup previously applied to the cheek.

Another object of the present invention is that the line between the top adhesive and area protecting the cheek is curved causing the bottom part to protrude away from the skin, creating a "ledge" to catch the falling makeup.

One more object of the present invention is that the front of the patch has a textured surface.

In brief, a makeup shield that is removably affixed under the eye for putting on eye makeup to prevent eye shadow, eyeliner, and mascara from falling on the skin below the eyes and on the cheeks; the makeup shield comprises a die-cut patch of material which is curved at the top to fit under the eye matching the curvature of the bottom eyelid, a front of the patch having textured surface to catch the falling eye makeup, a back of the patch having a weak adhesive thereon which is kind to the skin, and a peel-off strip over the entire back adhesive surface which is scored so that a narrow multi-scored top peel-off strip may be peeled off in its entirety or just two ends of the top peel-off strip and the shield adhered to the skin under the eye, the bottom part of the peel-off strip being left in place so that the shield does not stick to the cheek and does not disturb any makeup on the cheek.

An advantage of the present invention is that makeup that would normally fall onto the face of the person applying it, is caught by a shield.

An additional advantage of the present invention is the shield has a textured surface to easily catch the makeup that would normally fall onto the face.

Another advantage of the present invention is that the shield has a weak adhesive that is kind to the skin and peels off easily without leaving a mark.

One more advantage of the present invention is the curvature between the top area that adheres to the skin and the bottom area that catches the stray makeup acts as a bend line, extending the shield portion away from the skin.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings:

FIG. 1 is a perspective view of the eye makeup shield of the present invention applied under the eye of a user showing the upper peel-off strip removed, the upper attaching portion adhered to the skin of the user under the eye forming a bend line (17) in the shield so that the bottom cheek shielding portion extends out over the cheek to catch the falling eye makeup particles by the eye makeup;

FIG. 2 is a front elevational view of the eye makeup shield of the present invention showing the front textured surface;

FIG. 3 is a back elevational view of the eye makeup shield of FIG. 2 showing the back peel-off surface over the adhesive backing of the shield with a scored line across the peel-off strip dividing into a thin upper peel-off strip which is removed for application and a lower larger peel-off strip which remains on the shield for application;

FIG. 4 is a front elevational view of the sheet of adhesive tape (22) with the die cut shapes of the shield cut into the textured front surface (21);

FIG. 5 is a back elevational view of the sheet of adhesive tape with the die cut shapes of the shield cut into the back peel-off backing sheet showing the scored lines in the peel-off backing to form the separate peel-off strips;

FIG. 7 is a perspective view of the multi-scored eye makeup shield of the present invention applied under the eye of a user showing the two ends of the upper peel-off strip removed, the upper two ends of the attaching portion adhered to the skin of the user under the eye forming a bend line in the shield so that the bottom cheek shielding portion extends out over the cheek to catch the falling eye makeup particles by the eye makeup;

FIG. 8 is a front elevational view of the multi-scored eye makeup shield of FIG. 7 showing the front textured surface;

FIG. 9 is a back elevational view of the multi-scored eye makeup shield of FIG. 8 showing the back peel-off surface over the adhesive backing of the shield with a scored line across the peel-off strip dividing into a thin multi-scored upper peel-off strip which is removed for application in its entirety or on just the ends and a lower larger peel-off strip which remains on the shield for application;

FIG. 10 is a front elevational view of the sheet of adhesive tape with the multi-scored die cut shapes of the shield cut into the textured front surface;

FIG. 11 is a back elevational view of the sheet of adhesive tape with the multi-scored die cut shapes of the shield cut into the back peel-off backing sheet showing the scored lines in the peel-off backing to form the separate peel-off strips.

DETAILED DESCRIPTION OF THE INVENTION

Figure 6:
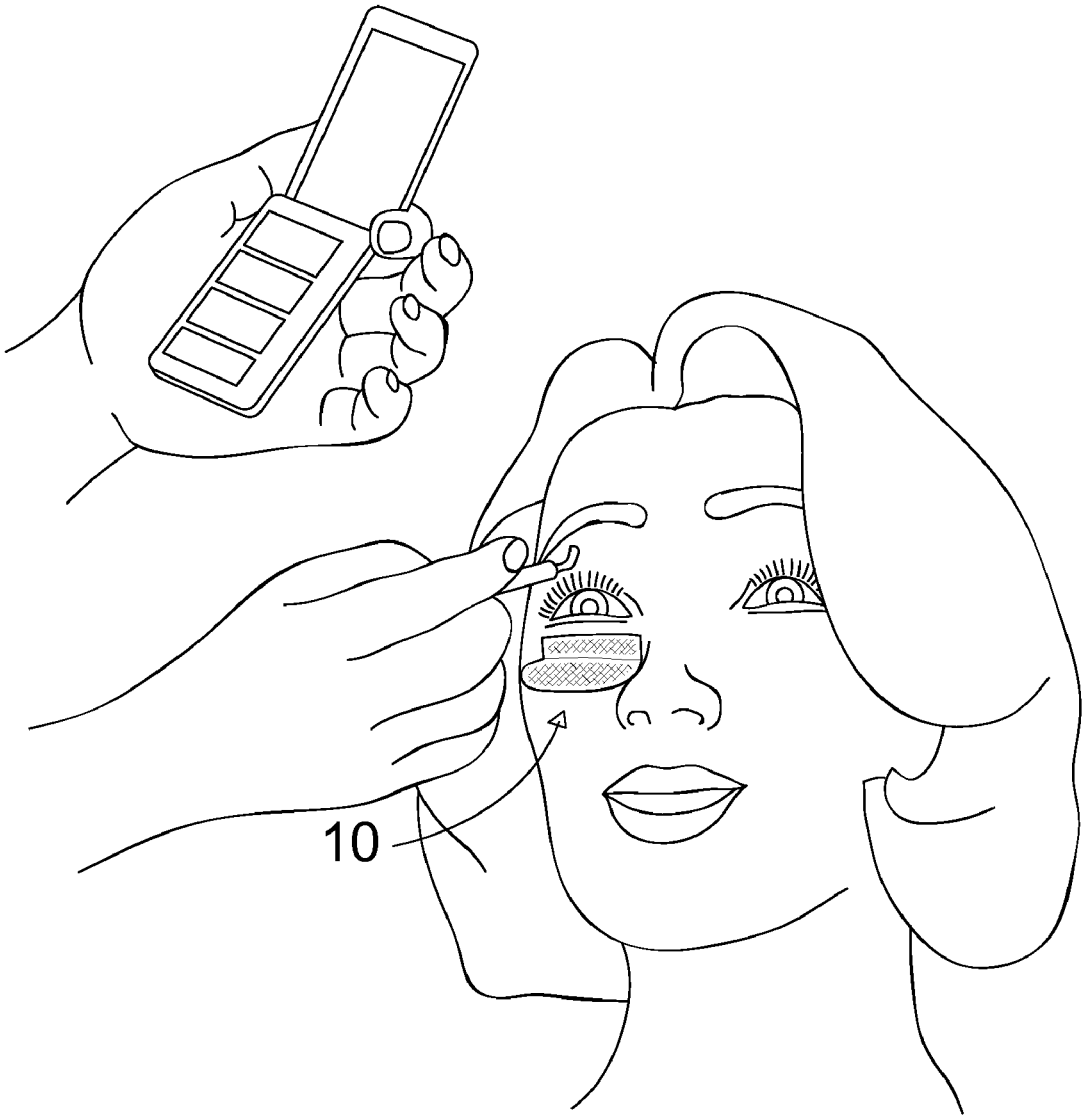
FIG. 6 is a perspective view of the eye makeup shield of the present invention applied under the eye of a user showing the eye makeup being applied to the eye of the user with both hands of the cosmetician used with one holding the makeup applicator and the other holding the makeup palette.

In FIGS. 1-11, an attachable eye makeup shield system comprising a plurality of planar makeup shields 10 and 10A cut from a sheet of human skin adhering tape 20. Each of the shields is shaped with an upper attaching portion 11A and 11C having a concave arched upper edge to fit under an eye of a user and a lower cheek shielding portion 11B having a convex arched edge to shield a cheek of the user. The shield has a front textured surface 11 for catching and holding makeup 30 thereon.

In FIGS. 3 and 9, a back adhesive surface 15 is covered by a peel off strip 12A, 12B, and 12C over the back adhesive surface, the peel off strip having an arched score line 14 matching the concave arched upper edge and spaced apart therefrom and two extending vertical score lines to form an upper peel off strip 12A and a lower peel off strip 12B over an upper and a lower back adhesive surface 15 respectively, in FIG. 3, and in FIG. 9 two end peel off strips 12A and a center peel off strip 12A. The upper peel off strips 12A and 12C are removed by a user, as shown in FIGS. 1 and 7, to adhere the upper back adhesive surface 15 of the attaching portion 11A removably to a user's skin under one of the eyes of the user, is in FIG. 6, and the lower peel off strip 12B remains on the lower back adhesive surface of the cheek shielding portion 11B, so that the lower peel off strip 12B contacts a portion of the cheek of the user to prevent the lower back adhesive surface from disturbing foundation and makeup on the cheek of the user.

The front texture surface 11, 11A and 11B catches falling bits of eye shadow, eyeliner, and mascara eye makeup to prevent the eye makeup 30 from contacting the skin of the user under the eye and on the cheek while eye makeup is being applied around the eye of the user, as shown in FIG. 6. The shield adhesive 15 is gentle to the skin to enable easy removal of the shield to dispose of the shield along with fallen eye makeup 30 collected on the shield with no damage to the skin or to the foundation or the makeup previously applied to the cheek of the user.

In FIGS. 4, 5, 10, and 11, the plurality of shields 10 are die cut from the sheet of skin adhering tape 20 with the score lines 14 cut into the peel off strips over the adhesive surface of the back of the sheet, as shown in FIGS. 5 and 11. The skin adhering tape preferably comprises white non-woven medical pressure sensitive tape with adhesive on one side covered by a peel-off strip.

In FIGS. 7 and 9, the two outer upper peel off end strips 12C may be removed to attach two ends of the upper adhesive attaching surface 15 under the eye of the user to limit the amount of skin contact and limit disruption of existing makeup on the skin of the user. Alternately, as in FIGS. 1 and 3 (or FIGS. 7 and 9), all of the upper peel off strips 12A and 12C are removed to attach the entire upper adhesive attaching surface 15 under the eye of the user to for maximum holding power and to create a greater lifting of the lower cheek shielding portion 11B toward a horizontal orientation away from the face of the user for greater spilled make up catching effectiveness and lees contact with the cheek, as in FIG. 6.

In use, the eye makeup shield upper peel off end strips 12C or the entire upper peel off strips 12A and 12C are removed to reveal the weak adhesive backing 15 on the narrow upper attaching portion 11A which is adhered to the skin under an eye of a user, as shown in FIGS. 1 and 7. The textured surface 11 on the upper attaching portion 11A and lower cheek shielding portion 11B catches fallen eye makeup particles 30 including eye shadow, eyeliner, and mascara to prevent them from falling on the skin below the eyes and on the cheeks. The larger lower peel-of strip 12B is left in place on the bottom cheek shield portion 11B so that the shield does not stick to the cheek and does not disturb any makeup or foundation already on the cheek. The skin sensitive weak adhesive backing 15 is such that the shield may be removed with no damage to the skin, and the shield is disposable with the dropped particles of eye makeup 30 after completing putting on eye makeup.

It is understood that the preceding description is given merely by way of illustration and not in limitation of the invention and that various modifications may be made thereto without departing from the spirit of the invention as claimed.

What is claimed is:

1. An at least substantially planar eye makeup shield including a bend line separating an upper attaching portion from a lower cheek-shielding portion, a) the upper attaching portion having:

1) a concave upper edge configured to fit under an eye of a user; and 2) an upper back surface defined between the upper edge and the bend line, the upper back surface having adhesive thereon;

b) wherein:

1) the bend line is concave in the same direction as the concave upper edge; and 2) when the upper attaching portion is pressed against the user, the lower cheek-shielding portion bends at the bend line and lifts away from the user.

2. The makeup shield of claim 1 wherein the bend line has a curvature at least substantially matching the curvature of the upper edge of the upper attaching portion.

3. The makeup shield of claim 2 wherein the makeup shield further includes an upper peel off strip removably adhered to the upper back surface.

4. The makeup shield of claim 3 wherein:

a) the upper peel-off strip has at least two score lines dividing the upper peel-off strip into at least two upper peel-off end strips on opposing sides of an upper peel-off center strip; and b) each of the upper peel-off end strips and the upper peel-off center strip is separately detachable from the upper back surface.

5. The makeup shield of claim 1 wherein the lower cheek-shielding portion includes a front textured surface configured to catch makeup falling thereon.

6. The makeup shield of claim 5 further including:

a) a lower back surface opposing the front textured surface, the lower back surface:

1) being below the upper back surface; and 2) having adhesive thereon; and b) a lower peel-off strip removably adhered to the lower back surface.

7. An at least substantially planar eye makeup shield including a concave bend line separating an upper attaching portion from a lower cheek-shielding portion, a) the upper attaching portion having an upper back surface having an adhesive thereon, the upper attaching portion defined between an upper edge and the bend line, and b) the lower cheek-shielding portion having a front textured surface opposing the upper back surface;

c) wherein the makeup shield is configured such that when the upper attaching portion is pressed against the user, the lower cheek-shielding portion bends at the concave bend line and protrudes outwardly away from the user to form a ledge for catching falling makeup.

8. The makeup shield of claim 7 wherein:

a) the upper attaching portion includes a concave upper edge configured to complementarily fit under an eye of a user; and b) the bend line has a curvature at least substantially matching the curvature of the concave upper edge of the upper attaching portion.

9. The makeup shield of claim 7 further including an upper peel-off strip removably affixed to the upper back surface, a) the upper peel-off strip being divided into at least two upper peel-off end strips on opposing sides of an upper peel-off center strip, b) each of the upper peel-off end strips and the upper peel-off center strip being separately detachable from the upper back adhesive surface.

10. The makeup shield of claim 9 further including:

a) a lower back surface opposing the front textured surface, the lower back surface having adhesive thereon; and b) a lower peel-off strip removably affixed to the lower back surface, wherein the segments of the upper peel-off strip are configured to be detachable from the makeup shield without detaching the lower peel-off strip.

11. An at least substantially planar eye makeup shield including an upper attaching portion extending from a lower cheek-shielding portion, wherein: a) the upper attaching portion has:

1) a concave upper edge and a bend line;

2) an upper back surface having an adhesive thereon, the upper back surface defined between the upper edge and the bend line; and 3) an upper peel-off strip removably affixed to the upper back surface, the upper peel-off strip being divided into two or more segments, each of the segments being separately detachable from the upper back adhesive surface; and b) the bend line is configured such that when the upper attaching portion is pressed underneath an eye of a user, 1) the makeup shield bends at the bend line, and 2) the lower cheek-shielding portion is lifted to extend out of the plane of the makeup shield and away from the user.

12. The makeup shield of claim 11, a) the upper peel-off strip having two score lines dividing the upper peel-off strip into two upper peel-off end strips on opposing sides of an upper peel-off center strip, b) the score lines configured to make the upper peel-off end strips detachable from the upper back surface without detaching the upper peel-off center strip from the upper back surface.

13. The makeup shield of claim 12 wherein the bend line is complementarily concave with the concave upper edge.

14. The makeup shield of claim 13 wherein the bend line has a curvature substantially matching the curvature of the concave upper edge of the upper attaching portion.

15. The makeup shield of claim 14 wherein the lower cheek-shielding portion has a front textured surface opposing the upper back surface, the front textured surface being configured to hold makeup fallen thereon.

16. An at least substantially planar eye makeup shield including an upper attaching portion and a lower cheek-shielding portion on opposing sides of a concave bend line, wherein:

a) the upper attaching portion has a concave upper edge configured to complementarily fit under an eye of a user with the lower cheek-shielding portion extending down to cover at least a portion of a cheek of the user;

b) the lower cheek-shielding portion has a front textured surface configured to receive and hold makeup fallen thereon; and c) the concave bend line is configured to allow the lower cheek-shielding portion to bend with respect to the upper attaching portion, whereby when the upper attaching portion is pressed under the eye of the user, the lower cheek-shielding portion lifts upwardly away from the cheek of the user to form a ledge on which makeup can fall.

17. The makeup shield of claim 16 further including an upper back surface having an adhesive thereon, the adhesive being configured to removably secure the makeup shield to the user.

18. The makeup shield of claim 17 further including a lower back surface opposing the front textured surface.

19. The makeup shield of claim 18 further including:

a) an upper peel-off strip removably affixed to the upper back surface; and b) a lower peel-off strip removably affixed to the lower back surface, the lower peel-off strip being separated from the upper peel-off strip by the bend line.

20. The makeup shield of claim 19 wherein the upper peel-off strip is scored into at least two smaller strips, each of the smaller strips being separately detachable from the upper back surface.

* * * * *